US005251764A

United States Patent [19]

Niitti et al.

[11] Patent Number: 5,251,764

[45] Date of Patent: Oct. 12, 1993

[54] FLOTATION MACHINE

[75] Inventors: Timo U. Niitti, Vantaa; Jouko O. Kallioinen, Hollola, both of Finland

[73] Assignee: Outomec Oy, Espoo, Finland

[21] Appl. No.: 858,106

[22] Filed: Mar. 26, 1992

[30] Foreign Application Priority Data

Mar. 27, 1991 [FI] Finland ..... 911486

[51] Int. Cl.[5] ..... B03D 1/14; B03D 1/16

[52] U.S. Cl. ..... 209/169; 209/168; 261/87

[58] Field of Search ..... 209/168, 169, 170; 261/87

[56] References Cited

U.S. PATENT DOCUMENTS

| | | | |
|---|---|---|---|
| 2,061,564 | 11/1936 | Drake | 209/169 |
| 2,182,442 | 12/1939 | Booth | 209/169 |
| 2,369,401 | 2/1945 | Morash | 209/169 |
| 2,756,877 | 7/1956 | Sayers | 209/169 |
| 3,032,199 | 5/1962 | Sumiya | 209/170 |
| 4,668,382 | 5/1987 | Jameson | 209/169 |
| 4,964,576 | 10/1990 | Datta | 209/170 |
| 5,039,400 | 8/1991 | Kallioinen | 209/169 |

FOREIGN PATENT DOCUMENTS

| | | | |
|---|---|---|---|
| 146235 | 6/1985 | European Pat. Off. | 209/169 |
| 211494 | 7/1984 | German Democratic Rep. | 209/169 |

*Primary Examiner*—Thomas M. Lithgow
*Attorney, Agent, or Firm*—Smith-Hill & Bedell

[57] ABSTRACT

The invention relates to a flotation machine for flotating minerals from slurries containing these particles, the said flotation machine comprising a flotation cell and a mixer mechanism provided in the cell, an element for introducing air into the cell and an element for feeding the material to be flotated into the cell and for removing it therefrom. According to the invention, in the slurry chamber (2, 18) of the flotation machine, essentially below the foam bed (4, 21) created in the flotation machine, there is arranged at least one guide member (3, 19, 32), so that the free area of the flotation machine, essentially at least in the slurry chamber (2, 18) below the foam bed (4, 21) can be reduced when proceeding upwards.

6 Claims, 3 Drawing Sheets

FLOTATION MACHINE

The present invention relates to a flotation machine for flotating minerals or the like from slurries containing these particles, wherein the rising and travelling of the foam from the slurry contained in the flotation machine to the foam bed is controlled.

In flotation machines, the desired valuable mineral particles are put to contact with air bubbles by means of chemicals. The air bubbles rise on the surface of the slurry layer and form a foam layer, the height whereof in free space is normally only 5% of the height between the bottom of the flotation machine and the foam outlet spot. Normally it is attempted to recover the foam contained in the foam layer to outlet ducts attached in the wall of the flotation machine. From the practical point of view, a good result in the recovery of foam to the ducts requires a sufficiently thick foam layer, dependent on the mineral to be flotated and the respective stage in the flotation process. Generally a good result in the foam recovery to the ducts requires a relatively thick foam layer.

In special cells, aiming at good selectivity, where foam washing is applied, the creation of a sufficient foam layer by conventional means is often impossible. The reason for the difficulties in creating thick foam layers is the decomposition of the foam. As the foam decomposes, part of the mineral particles return to the slurry. Now new air bubbles are needed to raise the mineral particles back to the foam layer. This slows down the speed of the flotation process, the air-utilisation efficiency is reduced and the surplus air brings more and more valueless minerals and materials mechanically to the foam.

The rate of the creation and decomposition of the foam are dependent, among others, on the structure of the flotation machine, on the material under treatment and on the process stage at hand. Several factors can also be distinguished in the foam decomposition process. In most cases, time is one of the most important parameters. In some cases, for instance, a foam layer with the height of 100–200 mm is decomposed in less than ten seconds. The mineral particles that are left from the decomposing foam can return directly to the slurry for instance in the middle part of the flotation machine. If the foam flows very slowly to the outlet ducts, but the creation rate of the foam is high, the decomposing foam may gradually develop so heavy mineral particle accumulations that these accumulations sink back to the slurry through the foam layer. Powerful, disturbing slurry flows under the foam layer may also tear the bottom surface of the foam layer. These foam-breaking processes are intensified along with the growth of flotation machines.

In average, the foam recovery rate $K_R$ on the whole foam surface of the flotation machine is the difference of the average creation rate $K_B$ and the decomposition rate $K_D$ of the foam, i.e.

$$K_R = K_B - K_D \quad (1)$$

when the employed velocity unit is m/s.

In the following survey of magnitudes, it is seen that the quantities $K_B$ and $K_D$ described in formula (1) can be of the same magnitude, in which case it is probable that a remarkable part of the foam is decomposed and the mineral particles return to the slurry. For instance in a flotation cell of one cubic meter, with a free slurry area of 1 $m^2$, and an air supply rate of 0.1–0.5 $m^3$/min, the foam creation rate $K_B$ is 0.1–0.5 m/min, which means 17–83 mm per 10 seconds. With several minerals, the foam decomposition rate $K_D$, which is controversial to the foam creation rate, can be essentially equal.

In large flotation cells, the foam creation rate $K_B$ per area unit grows, because for example in a flotation cell with a volume of 100 $m^3$, with an air supply rate of 10–50 $m^3$/min, and a slurry surface of 25 $m^2$, the foam creation rate $K_B$ is 0.4–2.0 m/min, i.e. roughly four times as high as with the one cubic meter flotation cell of the reference example above.

However, when the size of the flotation machine grows, the slurry surface of the machine extends wide, and simultaneously the distances from the middle part of the flotation machine to the foam outlet ducts increase. Consequently the foam delay time in the middle of the flotation machine is extended more than at the edges.

The changing of the surface flows of the foam is described in the aerating device of the U.S. Pat. No. 2,182,442, where the flow of the foam created in the bottom part of the apparatus is controlled by means of a guide member provided in the inner part of the apparatus, so that foam is directed towards those edges of the aerating device where the outlet duct for the foam is located. In the top part of the aerating apparatus of this U.S. Pat. No. 2,182,442, essentially at the outlet ducts, there is arranged a guide member, having the shape of a truncated wedge, so that the horizontal bottom of the guide member is located below the foam surface of the aerating device. This guide member directs the created foam towards the outlet ducts provided on two walls of the aerating device, so that the foam is prevented from flowing to around the rotatory axis of the aerating device. Thus the purpose of the guide member is to protect the rotor axis of any unfavourable influences of the foam.

From the FI patent 78,628, there is known a flotation machine where inside the created foam bed, there is installed a downwards narrowing, wedge-like or conical adjusting member to adjust the volume and/or area of the foam bed. This adjusting member helps make the foam bed thick, and at the same time the foam is directed, when proceeding upwards, towards the walls of the flotation machine and hence towards the outlet ducts provided in the walls.

The wedge-like or conical guide members of the above described patents, located at least partly inside the foam, force the foam to flow towards the outlet ducts of the flotation cell, but they do not essentially change or speed up the creation of the foam nor its process from the slurry to the foam bed. The U.S. Pat. No. 4,668,382 describes a flotation method where on the border surface between the slurry and the foam bed in a flotation machine, there is installed a guide member for air bubbles. By means of this member, air bubbles are directed to a foam uptake shaft located centrally with respect to the slurry surface in the flotation machine. The transversal cross-sectional area of the foam uptake shaft is smaller than the free area of the flotation machine. By reducing the area, the foam creation rate is increased. Because the air bubble guide member described in the U.S. Pat. No. 4,668,382 is arranged only on the border surface between the slurry and the foam bed, the phenomena taking place in the slurry surface of a flotation machine cannot be essentially controlled by following the method of the U.S. Pat. No. 4,668,382.

Hence it is the object of the present invention to achieve an improved flotation machine, more secure in operation and with an essentially large volume, where the drawbacks of the priorart are remarkably decreased by changing and increasing the creation rate of the foam created in the flotation machine as well as its process from the slurry of the flotation machine to the foam bed, and by further increasing the recovery of the foam contained in the foam bed from the flotation machine. The essential novel features of the invention are apparent from the appended patent claims.

According to the invention, in the slurry chamber of the flotation machine, essentially below the foam bed created in the flotation machine, there is installed at least one adjustable guide member, so that the free surface area of the slurry and foam is decreased while proceeding from bottom to top in the flotation machine. In shape this guide member is advantageously wedge-like, conical, a truncated wedge or a truncated cone, so that the guide member is narrowed either upwardly or downwardly. Advantageously the guide member is arranged so that the restricting effect caused thereby in the slurry chamber of the flotation machine begins at a height which is 30–50% of the distance between the bottom of the flotation machine and the foam outlet spot, i.e. the lowest point of the overflow edge, when measured from the bottom of the flotation machine. The guide member is advantageously designed so that its narrowing angle is changed at least once, which means that the guide member is formed of several interconnected and essentially similar elements. The multielement structure of the guide member is advantageous particularly when the guide member is essentially extended from the slurry chamber to inside the foam bed.

By employing the guide member of the invention, the creation rate of the air bubbles proceeding from the slurry chamber to the foam bed in the flotation machine, i.e. the creation rate of the foam, is advantageously increased when the guide member of the invention is used for restricting the free slurry surface in the flotation machine, so that the ratio between the free slurry surface area and the free uptake surface area on the bottom surface of the foam bed can be between 1:2–1:20. Thus the free uptake area of the rising air bubbles is essentially decreased by means of the guide member of the invention. As the area is reduced, the height, of the created foam bed grows, so that the bottom surface of the foam bed is located at a height corresponding to 80–90% of the height between the bottom of the flotation machine and the foam outlet spot, i.e. the lowest point of the overflow edge, when measured from the bottom of the flotation machine.

The volume flow of the air bubbles containing mineral particles per area unit grows as the free area is reduced, and the thickness of the foam bed grows essentially more rapidly than if the free slurry surface were not reduced. When employing the guide member of the invention, the creation rate of the foam created by the air bubbles containing mineral particles is increased in an advantageous fashion, essentially by following the ratio of the areas, which means that the creation rate in the slurry chamber of the flotation machine, particularly on the border surface between the slurry surface and the foam bed, can in an optimal case grow even 20 times higher, depending on the mineral to be flotated.

When using, according to the invention, a guide member in a flotation machine to reduce the free slurry surface, the creation rate of the foam formed by air bubbles containing mineral particles is increased essentially, even many times higher than the decomposition rate of the air bubbles. Thus the delay time of the air bubbles in the foam beds is essentially shortened.

According to the invention, the guide member of the flotation machine of the invention can be installed adjustably, so that the restrictions of the areas, i.e. the reduction of free area, achieved by means of this guide member, can be separately regulated at the element of the guide member provided in the slurry chamber, and at the element of the guide member provided inside the foam bed respectively. The adjustability of the guide member can advantageously be utilized for example when the quality of the ore to be treated in the flotation machine from time to time varies,. and different flotation conditions are required. In similar fashion, different adjusting measures of the guide member at different stages of the process can be applied for instance for flotation machines of one and the same flotation circuit.

BRIEF DESCRIPTION OF THE DRAWINGS

The invention is below described in more detail with reference to the appended drawings, where

In FIG. 1, in the slurry chamber 2 of the flotation cell 1, there is arranged a guide member 3 of the invention, which guide member directs the foam created in the bottom part of the cell from the slurry chamber 2 to the foam bed 4 and further, via the foam bed 4 and the overflow edge 24, to the outlet duct 5. The angle of narrowing of the guide member 3 can advantageously be adjusted, so that the member 6 of the guide member 3 located in the slurry chamber, and the member 7 extending to inside the foam bed 4, can be separately adjusted by means of the adjusting members 8 and 9. Likewise, the height of the guide member with respect to the bottom 10 of the flotation cell is adjustable. In FIG. 1, there is also indicated quantity $D_1$ describing the whole free surface area of the slurry, and quantity $D_2$ describing the area of the bottom part of the foam bed 4, reduced by means of the guide member 3. When the quantities mentioned in the description of the prior art above are taken into account, i.e. the foam recovery rate $K_R$, the foam creation rate $K_B$ and the foam decomposition rate $K_D$, a connection corresponding to formula (1) can be deduced for these rates. According to the invention, the guide member 3 is used for reducing the area of the foam bed in the ratio $D_2$:$D_1$. Because all foam is now discharged through the smaller area, i.e. the area according to $D_2$, the formula (1) is changed as follows:

$$K_R = K_B - \frac{D_2}{D_1} K_D \qquad (2)$$

Now the average foam recovery rate increases, and respectively less time is left for the decomposition of foam. It is clear that formulas (1) and (2) are reliable with respect to magnitudes only, but they still describe, essentially successfully, the advantage achieved with the guide member of the invention in the discharge of foam from a flotation machine.

Figure 1:
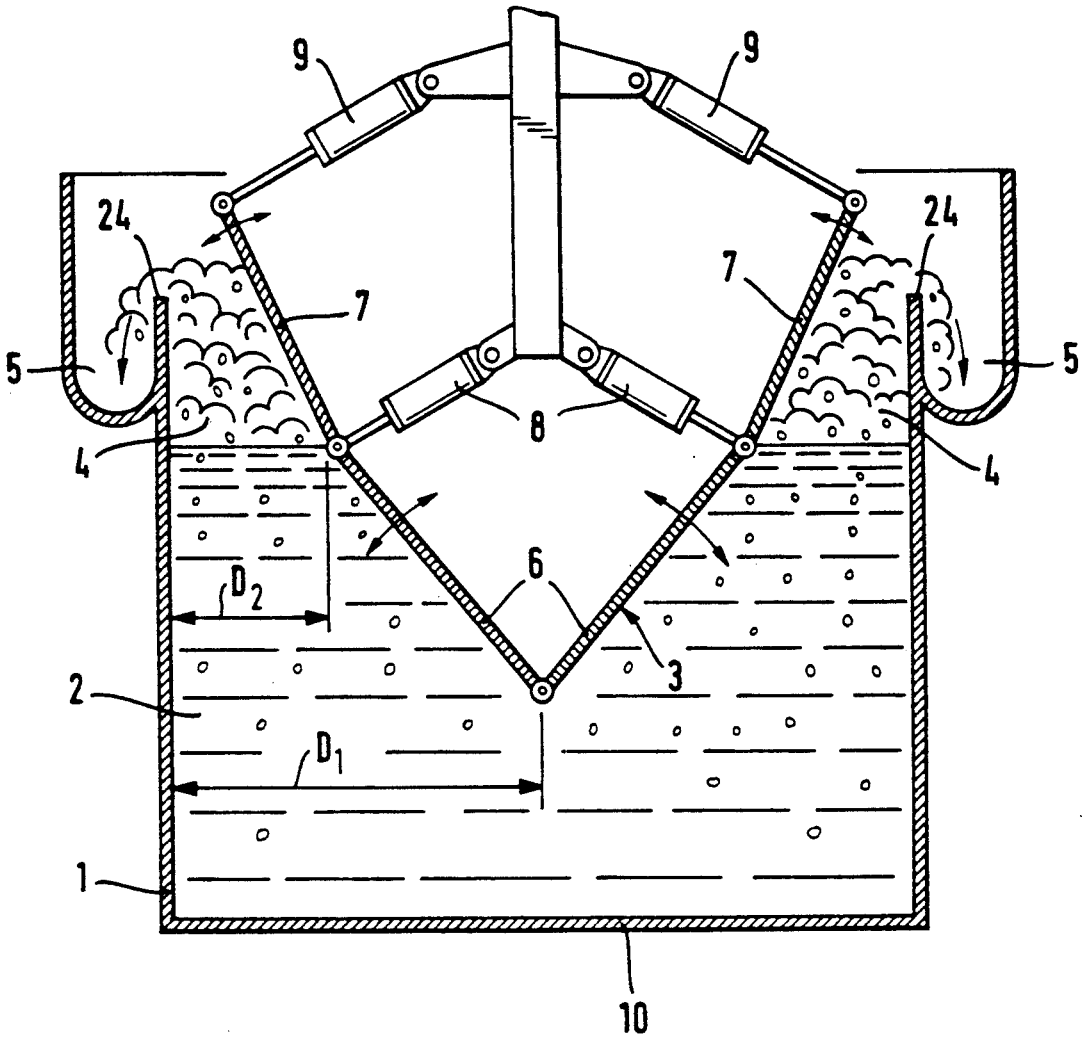
FIG. 1 illustrates the operating principle of the present invention, and a relevant explanation for the behaviour of foam in the flotation cell, seen as a schematical side-view elevation.
Figure 2:
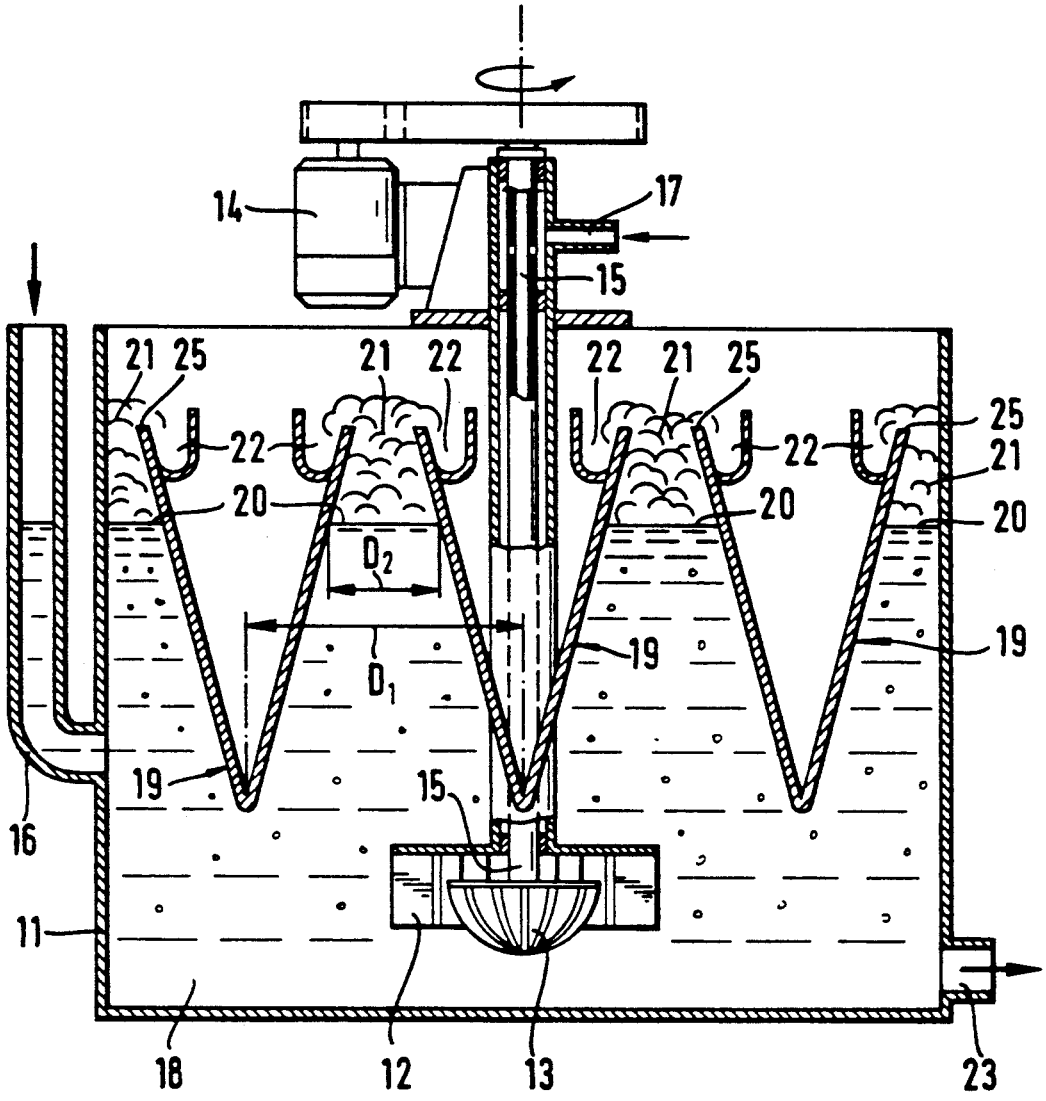
FIG. 2 illustrates a preferred embodiment of the invention as a schematical side-view elevation.

In FIG. 2, in the bottom part of the flotation cell 11 of the flotation machine, there is installed a stator 12 and a rotor 13. In order to rotate the rotor, a motor 14 is arranged above the flotation cell, and this motor is connected to the rotor 13 through a hollow axis 15. The material to be flotated is fed into the flotation cell 11 through the inlet 16. The air needed in the flotation is fed through the conduit 17 to the middle part of the hollow axis 15 and further onto the rotor 13. According to the invention, in the slurry chamber 18 formed by the material to be flotated there are arranged guide members 19 comprising downwardly narrowing conical elements, in order to reduce the free surface area of the slurry chamber 18. The guide members 19 are installed so that the conical shape of the members can be adjusted when necessary, either restricted or enlarged, in which case the area ratio $D_2/D_1$ illustrated in FIG. 2 can respectively be changed, for instance according to the material to be flotated. The air bubbles created by the rotor 13 and the air fed into the flotation cell 11, which air bubbles carry along particles of the material to be flotated, rise up in the slurry chamber 18 and further through the slurry surface 20 in between the guide members 19 to the foam bed 21 by means of the said guide members 19. Owing to the advantageous change int eh velocity, caused by the guide members 19 of the invention, the single air bubbles carrying valuable minerals rise essentially rapidly, so that they reach the edge 25 of the outlet ducts 22 and are discharged from the flotation cell 11 to further treatment. The valueless material received in the flotation cell 11 along with the supplied material is removed from the flotation cell 11 through the waste hatch 23.

Figure 3:
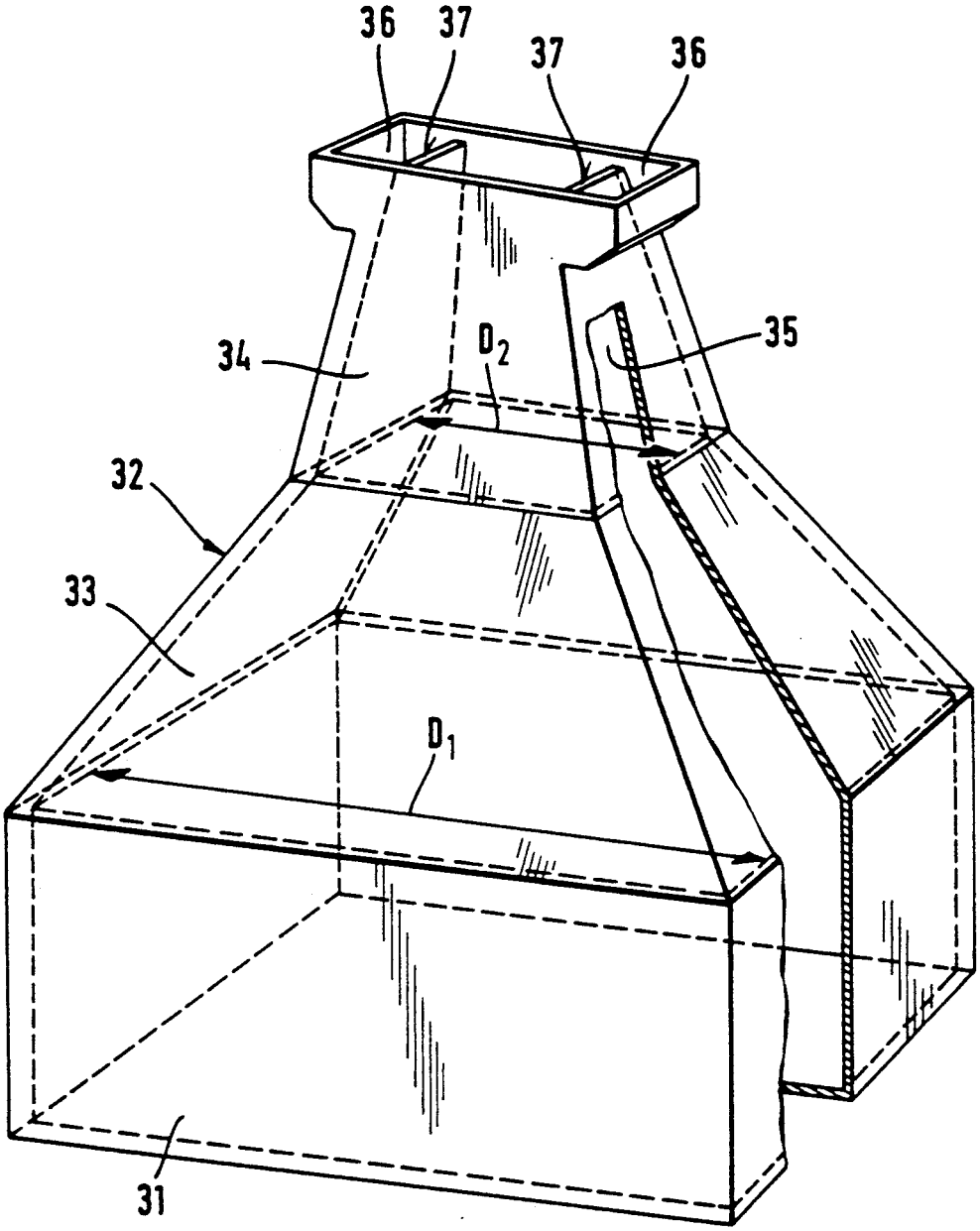
FIG. 3 illustrates an advantageous shape for the guide member of the invention to be provided in the slurry chamber.

In FIG. 3, the flotation cell 31 is provided with a guide member 32, which comprises several essentially interconnected elements 33 and 34, having the shape of a truncated wedge. The lower element 33 in the shape of a truncated wedge serves in the flotation cell 31 as a device for reducing the slurry area. The upper element 34 in the shape of a truncated wedge can advantageously be arranged as a pressure zone for the foam bed 35 formed of the air bubbles obtained from the flotation cell 31, and to this zone there can, when necessary, be connected for instance the washing of the material to be flotated, known from the FI patent 78,628. From the foam pressure zone formed by the element 34, the foam bed 35 is recovered to the outlet ducts 36 provided at the edges 37 of the element 34.

We claim:

1. A flotation machine for removing mineral particles from a slurry containing such particles, comprising:

a wall means defining a flotation cell, a feed opening for introducing slurry into the cell and a foam outlet for discharging foam from the cell, said flotation cell having a bottom that is at a predetermined vertical distance from the foam outlet, a mixing mechanism located inside the flotation cell, an air supply means for supplying air to the cell, whereby a foam bed is formed in the cell, and at least one baffle means disposed in said flotation cell for reducing the free horizontal cross-sectional area of the cell in the upward direction, said baffle means extending upwards from a position that is closer to the bottom of the flotation cell than to the foam outlet, wherein said baffle means comprises an upper baffle part and a lower baffle part, said lower baffle part being adjustably mounted in said cell and said upper baffle part being adjustably mounted to said lower baffle part, means to adjust the upper baffle part relative to the lower baffle part thereby changing the gradient of the free horizontal cross-sectional area of the flotation cell with respect to vertical position between the lower baffle part and the upper baffle part.

2. A flotation machine according to claim 1, wherein said position from which the baffle means extends from thirty to fifty percent of said predetermined vertical distance above the bottom of the flotation cell.

3. A flotation machine according to claim 1, wherein the minimum free horizontal cross sectional area of the flotation cell is between one half and one twentieth of the maximum free horizontal cross sectional area of the flotation cell.

4. A flotation machine according to claim 1, wherein the baffle means is conical in shape.

5. A flotation machine according to claim 1, wherein the baffle means is wedge-like in shape.

6. A flotation machine according to claim 1, wherein the baffle means becomes wider in the upward direction.

* * * * *